US005664381A

United States Patent [19]

Betts

[11] Patent Number: 5,664,381

[45] Date of Patent: Sep. 9, 1997

[54] CONSTRUCTION NAILING METHOD AND STRUCTURES

[75] Inventor: Daniel L. Betts, Fredericksburg, Va.

[73] Assignee: Deck America, Inc., Lorton, Va.

[21] Appl. No.: 538,125

[22] Filed: Nov. 29, 1995

[51] Int. Cl.[6] ..... E04B 1/00

[52] U.S. Cl. ..... 52/263; 52/745.13; 52/777; 52/780; 52/800.1; 52/801.11

[58] Field of Search ..... 52/745.05, 747.1, 52/745.21, 263, 630, 457, 483.1, 800.1, 801.1, 801.11, 801.12, 664, 665, 745.13, 745.2, 777, 780; 108/51.1, 52.1, 49, 42

[56] References Cited

U.S. PATENT DOCUMENTS

| | | | |
|---|---|---|---|
| 1,710,108 | 4/1929 | Orrock | 52/457 |
| 4,229,919 | 10/1980 | Hughes | 52/263 |
| 4,622,792 | 11/1986 | Betts | 52/263 |
| 5,404,683 | 4/1995 | Hammonds et al. | 52/263 |
| 5,485,794 | 1/1996 | Sing | 108/51.1 |

FOREIGN PATENT DOCUMENTS

| | | | |
|---|---|---|---|
| 2835 | 11/1861 | United Kingdom | 52/483.1 |

*Primary Examiner*—Michael Safavi
*Assistant Examiner*—Timothy B. Kang
*Attorney, Agent, or Firm*—Beveridge, DeGrandi, Weilacher & Young, LLP

[57] ABSTRACT

A climate resistant decking structure and method for providing same incorporating modules and a frame where the modules are constructed using an undernailing technique with profiled shank nails and corrugated nails driven into planking, joist, and nailer boards in a manner where the finished assembly has an exposed surface clear of imperfections caused by nailing.

10 Claims, 2 Drawing Sheets

CONSTRUCTION NAILING METHOD AND STRUCTURES

TECHNICAL FIELD

The present invention is directed to a method of construction and structures resulting from the method. More particularly, the invention is directed to an assembly method for wooden structure modules in which profiled shank nails and corrugated nails of selected length are driven into the structure from the unexposed surface of the structure so as to leave the exposed surface clear of imperfections and aesthetic flaws.

BACKGROUND OF THE INVENTION

Wooden decking structures such as those described in Applicant's earlier issued patents, namely, U.S. Pat. No. 4,622,792 and U.S. Pat. No. 5,134,813, typically are subject to harsh climatic conditions.

The two most common components of decking materials, wood planks and nails exhibit significantly different physical characteristics, particularly upon extended exposure to cyclical changes in ambient conditions. In temperate climates, during the warmer months, decks are routinely exposed to rain and direct, unfiltered sunlight. During the winter, as a result of heavy snowfalls and ice, the deck surface may be subject to multiple freeze-thaw cycles which amplify the different thermal expansion coefficients of the metal and wood.

First, the coefficients of thermal expansion of metal and wood cause different dynamics with regard to expansion and contraction. Secondly, the shape stability of wood depends on moisture content where, in contrast, ambient moisture plays little role in the shape stability of the metal fasteners, e.g., nails (disregarding oxidation/rusting). As a result of repeated thermal and moisture cycles, the differences between the wood and the metal fastener structures used to secure the wood, particularly in the case of a deck surface module, generate pronounced boundary faults which manifest themselves in ever larger, cracks, split ends, pits, or gaps in the wood itself, and particularly, between the metal nails and the wood planking. These boundary faults lead to progressive separation of nails from planking and correspondingly larger exposed surface flaws such as gaps between abutting wood planking, cracks in the wood planking, checking, split ends, exposed nail heads projecting above the planking surface, and exposed nails located in the planking gaps.

Once a gap/crack/split end is established, repeated penetration of rainwater and/or ice (a third solid possessing its unique thermal expansion properties, particularly nearing the 0° C. mark) promotes and exacerbates such flaws. Water behaves differently than either the wood of the planking or the metal of the nails, and actually expands during the lower end of its liquid phase just before freezing. Thus, freeze-thaw cycles contribute to the deterioration of the wood-metal interface, and hence, the overall structure. In view of these structural aging problems, exposure such as sunlight, moisture, and thermal cycles has long been recognized as the primary cause of structural aging and deterioration. A market for rehabilitory coatings and preservatives has been well established to facilitate decking maintenance, without which, the deleterious effects of the weathering process become more pronounced.

The foregoing effects not only adversely impact on the overall appearance of the structure but also, in the aggregate, may compromise the integrity of the decking structure and create a safety problem.

As a matter of basic construction technique, decking structures and the like are typically constructed where the nails are driven through the upper, exposed surface. It is evident that it is more expedient to drive nails through that upper, exposed surface. In part, this expediency has retarded construction practices of conventional decking structures and modules.

SUMMARY OF THE INVENTION

It is an object of the present invention to overcome the problems in the prior art construction nailing techniques and structures.

Another object of this invention is to provide an improved construction nailing technique and resulting structures.

A further object of this invention is to provide a novel construction nailing technique and resulting structure that, at once, provides improved aesthetics, prolonged structural integrity, and maintains sufficient structural strength to meet appropriate building codes.

Another object of this invention is to avoid the presence of nail heads on the upper surface of a finished decking structure.

Still a further object of this invention is to provide a construction nailing method that can be standardized.

Still another object of this invention is to permit prefabrication of uniform and aesthetically pleasing structures, including decking, from prefabricated modules, for subsequent field assembly.

These and other objects are satisfied by a deck structure module comprising a plurality of deck surface boards extending a first direction; a select plurality of joist boards projecting below said deck surface boards and disposed perpendicular to said first direction; a plurality of nailer boards aligned perpendicular to said deck surface boards and both parallel and adjacent said joist boards, said nailer boards being secured to said joist boards and being attached to said deck surface boards by driving a plurality of nails having a length less than the combined depth of the nailer boards and deck surface boards, through the nailer boards and into the deck surface boards.

Other objects are satisfied by a method of constructing a decking structure flooring module, using a plurality of decking boards, joist boards, and nailer boards, comprising the steps of:

a) aligning in an abutting relation and nailing the joist boards and the nailer boards together where the top of the joist boards are flush with one surface of the nailer boards to form a support surface;

b) arranging the combined nailer and joist boards in a spaced, parallel relationship;

c) positioning the decking boards on the combined nailer and joist boards to juxtapose the support surface; and d) nailing the nailer boards to the decking boards in a manner where the nails do not penetrate the decking board surface opposite that abutting the support surface.

The instant invention serves to enhance both the appearance of a wooden decking structure and its structural integrity. The inventive technique employed to produce a wooden decking type structure according to the invention requires that the securing nails used to hold the decking structure together are driven into the underside of the finished structure. As a result the deleterious effect of adverse climatic conditions are minimized. Further, as a matter of comfort and safety, there are no nail heads to project above the upper, exposed deck surface or to protrude into gaps in the resulting structure.

The invention provides a construction method and decking structures which are capable of standardized, uniform factory fabrication with final assembly being achieved in the field or complete field assembly, albeit less desirable. It is also important that the invention described is capable of uniformly meeting or exceeding applicable industry standards and local building codes associated with decking and deck-type structures.

Given the following enabling description of the drawings, the inventive construction nailing method and decking structures produced thereby should become evident to a person of ordinary skill in the art.

DETAILED DESCRIPTION OF THE PREFERRED EMBODIMENT

Figure 1:
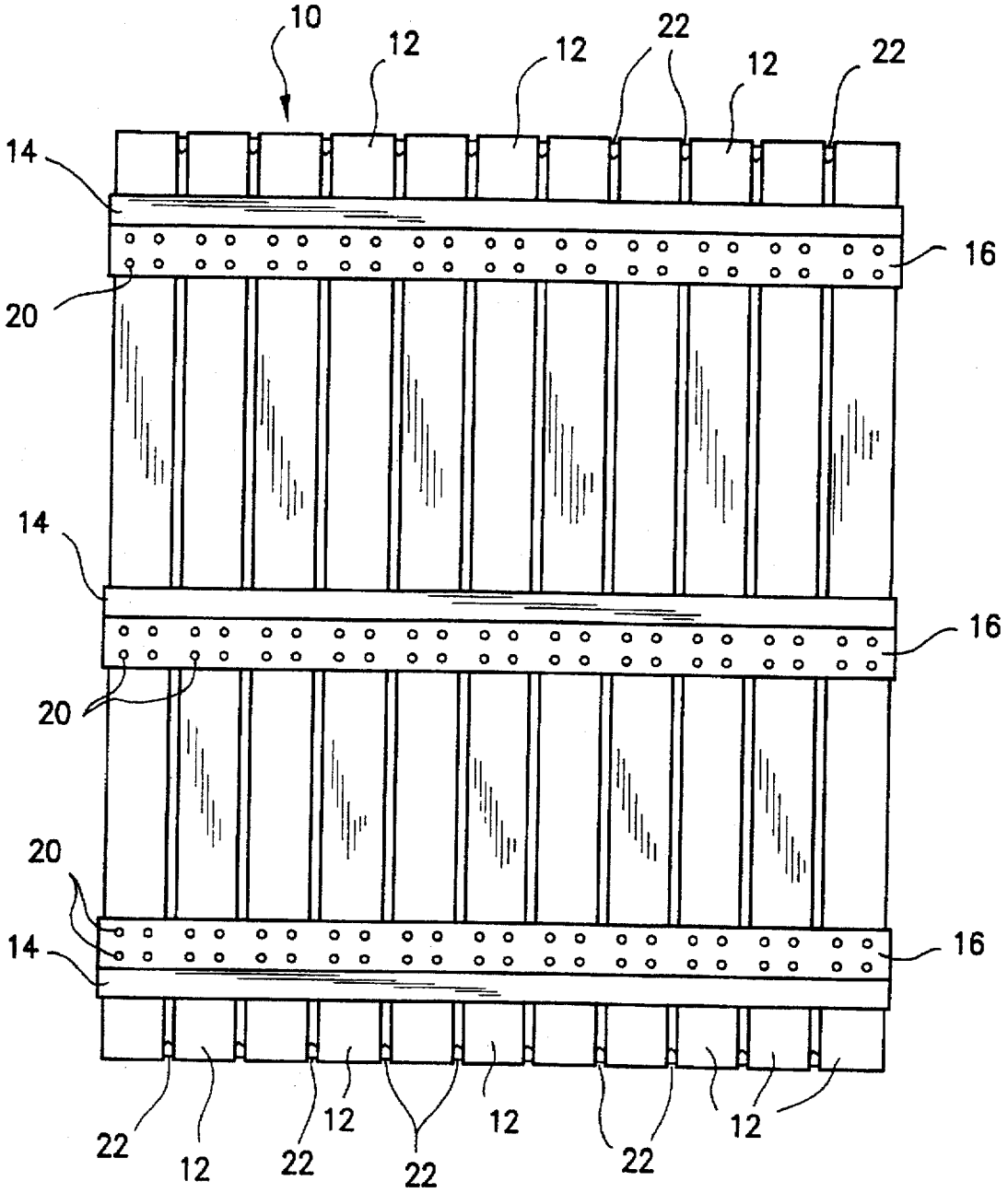
FIG. 1 is a bottom view of a decking module in accordance with this invention.
Figure 3:
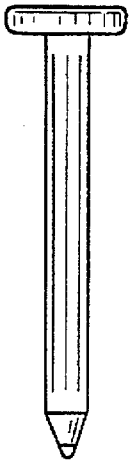
FIG. 3 is a side view of a ribbed nail used in connection with the invention.
Figure 4:
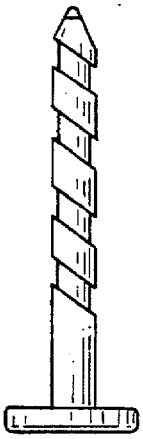
FIG. 4 is a side view of a spiral nail used in connection with the invention.
Figure 2:
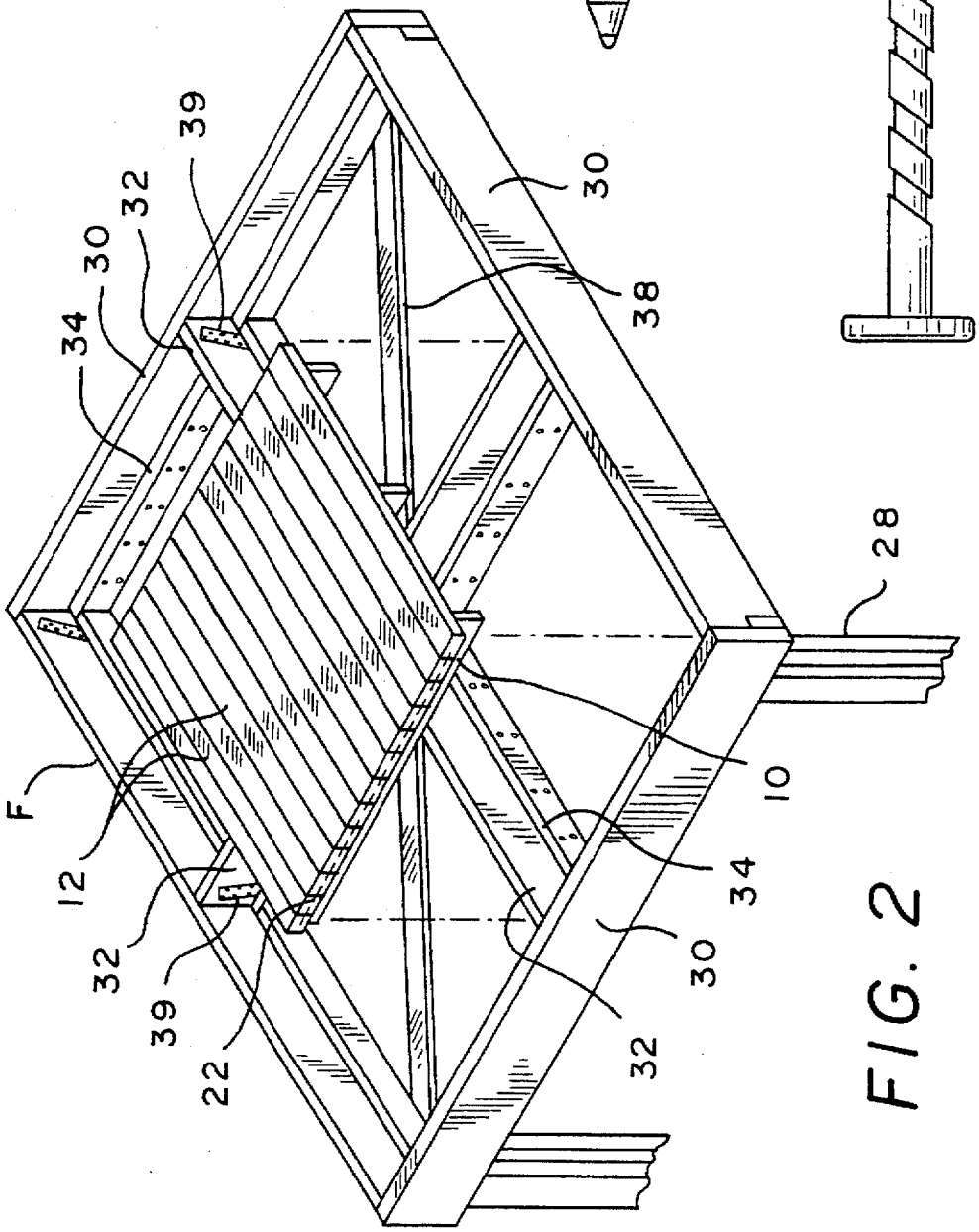
FIG. 2 is a perspective assembly view of a decking structure according to the invention.

In FIG. 1 a pre-assembled, factory built, portable module 10 is depicted. The portable flooring module 10 embodies the inventive construction technique. There are thirteen top decking boards or slats 12, of conventional dimensions, e.g. ¾" by 4" pressure treated planks cut into lengths of approximately 45" inches. More precisely, the specific dimensions of the boards 12 are 1"×3½"×45⅜". The boards 12 are assembled on a plurality, preferably three pressure treated joist boards 14, disposed perpendicularly to the bottom of the decking boards 12 and are of corresponding length and somewhat greater strength. Preferably, the dimensions of the joist boards 14 are 1½"×4"×45⅝". In order to minimize torquing effects on the module, i.e. warping and twisting of the decking boards, it is preferred that the joist boards be located in the middle and proximate to the ends of the decking boards.

Perpendicularly abutting the joist boards 14 and underlying the decking boards 12 are nailer boards 16. Where the joist boards 14 are positioned proximate to the end of the decking boards, the nailer boards 16 should be disposed on the inside of the boards. The nailer boards 16 are essentially the same size as the decking boards 12 (1"×3½"×45"). The nailer boards 16 are secured to the joist boards 14 by driving a plurality, preferably seven, of three inch (3") profiled nails 18, that is nails with a non-cylindrical shaft such as spiral, ribbed, etc. In the case of nails 18 it is preferred that they have a spiral shank and be driven through the joist boards 14 and into the nailer boards 16. In this way the nailer boards 16 are secured perpendicular to and lie flush against the bottom of the decking boards 12.

The nailer boards 16 are nailed to the decking boards using 1¾" rib shank nails from the nailer board to the decking boards 12. Preferably, four ribbed nails 20 are driven into each decking plank 12 from each nailer board 16.

As a final securement means for the decking boards in respect to the module, a corrugated nail (1"×1½") 22 is driven into the end of adjacent decking boards 12 forming a lateral bridge between each board at both ends.

The result of the foregoing is to provide a decking module without nails or fastening means lying in or projecting from the upper, exposed surface. In this manner, and in accordance with the invention, the decking module possesses sufficient strength to meet building code standards and also improves aesthetics of the finished product. Significantly, the securing nails are concealed from adverse environmental forces and are hidden from view relative to the upper surface of the decking module 10.

The modules 10 can be employed in conventional decking structures. However, it is preferred that the modules be set into a frame F that is constructed according to the teachings of Applicant's patent U.S. Pat. No. 4,622,792, incorporated herein by reference.

As should be readily apparent, because the modules 10 are of substantially uniform dimensions, they can be oriented in any manner to produce a desired effect, e.g., parquet, linear, etc. It is possible to produce modules other than in a square shape. For example, non-rectangular configurations such as rhomboids, octagons, etc. may be produced in accordance with the invention. The use of non-square shapes merely increase the complexity and cost of the underlying frame.

The general components of frame F are footers/ground posts 28 supporting a plurality of boarder joists 30 and interior joists 32. The interior of the boarder and interior joists feature shoulder planks 34 serving to define a peripheral internal supporting ledge for modules 10. The shoulder planks 34, preferably are flush with the bottom joists 30 and 32 and set at a distance relative to the top of the joists to permit the modules 10 to be supported by the shoulder planks 34 and the decking boards 12 of the modules to lie in a common plane above the frame F.

The frame F may also incorporate additional features such as a wind brace 38 extending beneath the platform and diagonally from an appropriate border joist to another border joist. Galvanized truss plates 39 may be used to reinforce the frame F.

Practice of the undernailing technique contemplated by invention herein provides for standardization and factory preassembly of modules. Thus, the climate resistant decking structures according to this invention are, at once, easily transportable for final field assembly, on-site, and provide structural strength to meet applicable building codes. The invention also enhances both the appearance of the finished constructed product by providing exposed modules (flooring, seating, etc.) with a smooth upper surface.

Given the foregoing, variations and modifications to the invention should now be apparent to a person having ordinary skill in the art. These variations and modifications are intended to fall within the scope and spirit of the invention as defined by the following claims.

I claim:

1. A deck structure module comprising:

a plurality of deck surface boards having a first depth extending a first direction;

a select plurality of joist boards projecting below said deck surface boards and disposed perpendicular to said first direction;

a plurality of nailer boards having a second depth aligned perpendicular to said deck surface boards and both parallel and adjacent said joist boards, said nailer boards being secured to said joist boards and being attached to said deck surface boards by driving a plurality of nails having a length less than the second depth of the nailer boards combined with the first depth of the deck surface boards, through the nailer boards and into the deck surface boards; and fastening means for securing the ends of adjacent deck surface boards said fastening means being corrugated nails driven into the ends of adjacent deck surface boards and bridging the space between said adjacent boards.

2. The deck structure module of claim 1 where the nailer boards are coextensive with said joist boards and the plurality of nailer boards equals the plurality of joist boards.

3. The deck structure module of claim 2 where there are three joist boards.

4. The deck structure module of claim 3 where there are thirteen substantially parallel deck surface boards per module.

5. The deck structure module according to claim 4 wherein the module is substantially square.

6. The deck structure module according to claim 1 where the nails are profiled nails and the nailer boards are secured to the joist boards by driving spiral nails through the joist boards and into the nailer boards.

7. The deck structure module according to claim 1 wherein the nails are ribbed.

8. In combination:

a plurality of platform modules, said modules comprising a plurality of platform surface planks having a first depth and extending a first direction where the platform modules are formed from a plurality of spaced, parallely disposed platform surface planks of a selected length and width;

a select plurality of joist boards projecting below said platform surface planks and disposed perpendicular to said first direction;

a plurality of nailer boards having a second depth, aligned perpendicular to said platform surface planks and both parallel and adjacent to said joist boards, said nailer boards being secured to said joist boards and being attached to said platform surface planks by driving a plurality of nails having a length less than the combined depth of the first depth of said nailer boards and the second depth of said platform surface planks, through the nailer boards and into the platform surface planks to provide platforms modules having selected dimensions and a surface free of nails;

a frame support assembly for supporting said plurality of said platforms, said frame support assembly including border joists defining the perimeter of said frame supporting member, a plurality of interior joists that establish along with the border joists provide framing members of appropriate dimensions corresponding to the dimensions of the platform modules, a select number of ground posts required for elevated support of the frame and platform modules;

interior shoulder planks attached to the interior of a select plurality of joists in a manner to receive a platform module and to seat the platform module in the frame; and corrugated nail fastening means driven into the ends of adjacent wooden planks and bridging the space between said adjacent planks.

9. The combination of claim 8 where the joist boards and nailer boards are nailed together using nails having profiled shanks and the nailer boards are nailed to the platform surface planks using ribbed nails.

10. A method of constructing a decking structure flooring module, using a plurality of decking boards, joist boards with a top surface, and nailer boards having at least one surface, comprising the steps of:

a) aligning in an abutting relation and nailing the joist boards and the nailer boards together where the top of the joist boards are flush with the at least one surface of the nailer boards to form a support surface;

b) arranging the combined nailer and joist boards in a spaced, parallel relationship;

c) positioning the decking boards on the combined nailer and joist boards to juxtapose the support surface; and d) nailing the nailer boards to the decking boards in a manner where the nails do not penetrate the decking board surface opposite that abutting the support surface; and e) driving corrugated nails into the ends of adjacent deck boards and bridging the space between said adjacent boards.

* * * * *